United States Patent [19]

Dempsey et al.

[11] 4,210,501

[45] Jul. 1, 1980

[54] GENERATION OF HALOGENS BY ELECTROLYSIS OF HYDROGEN HALIDES IN A CELL HAVING CATALYTIC ELECTRODES BONDED TO A SOLID POLYMER ELECTROLYTE

[75] Inventors: Russell M. Dempsey, Hamilton; Thomas G. Coker, Waltham; Anthony B. La Conti, Lynnfield, all of Mass.

[73] Assignee: General Electric Company, Wilmington, Mass.

[21] Appl. No.: 922,287

[22] Filed: Jul. 6, 1978

Related U.S. Application Data

[63] Continuation-in-part of Ser. No. 893,090, Apr. 3, 1978, abandoned, which is a continuation of Ser. No. 858,942, Dec. 9, 1977, abandoned.

[51] Int. Cl.[2] ..... C25B 1/34; C25B 1/46; C25B 11/02; C25B 13/00

[52] U.S. Cl. ..... 204/129; 204/98; 204/128; 204/282; 204/283; 204/296

[58] Field of Search ..... 204/DIG. 3, 128, 296, 204/98, 282, 283, 295, 129

[56] References Cited

U.S. PATENT DOCUMENTS

| | | | |
|---|---|---|---|
| 3,236,756 | 2/1966 | Beer | 204/98 |
| 3,291,708 | 12/1966 | Juda | 204/128 |
| 3,528,858 | 9/1970 | Hodgdon et al. | 429/33 |
| 3,857,737 | 12/1974 | Kemp et al. | 252/182.1 |
| 4,017,663 | 4/1977 | Breault | 429/12 |
| 4,043,933 | 8/1977 | Breault et al. | 252/182 |
| 4,057,479 | 11/1977 | Campbell | 204/252 |

FOREIGN PATENT DOCUMENTS

| | | | |
|---|---|---|---|
| 1163479 | 9/1969 | United Kingdom | 429/42 |

*Primary Examiner*—F. C. Edmundson
*Attorney, Agent, or Firm*—I. D. Blumenfeld

[57] ABSTRACT

A halogen such as chlorine is produced by the electrolysis of an aqueous solution of a hydrogen halide such as hydrochloric acid in an electrolysis cell having anolyte and catholyte chambers separated by a solid polymer electrolyte in the form of a stable, selectively permeable, hydrated ion exchange membrane. Catalytic electrodes in the form of fluorocarbon bonded, thermally stabilized, reduced oxides of platinum group metals are bonded to at least one surface of the membrane and an aqueous hydrochloric acid solution is brought in contact with the bonded anode to generate chlorine at the anode and hydrogen at the cathode.

22 Claims, 2 Drawing Figures

GENERATION OF HALOGENS BY ELECTROLYSIS OF HYDROGEN HALIDES IN A CELL HAVING CATALYTIC ELECTRODES BONDED TO A SOLID POLYMER ELECTROLYTE

This application is a Continuation in Part of our application Ser. No. 893,090, filed Apr. 3, 1978, now abandoned which, in turn, is a Continuation of our application Ser. No. 858,942, filed Dec. 9, 1977, now abandoned entitled "Chlorine Generation by Electrolysis of Hydrogen Chloride in a Cell Having a Solid Polymer Electrolyte Membrane with Bonded, Embedded, Catalytic Electrodes".

This invention relates generally to a process and apparatus for producing high purity halogens by electrolysis of aqueous hydrogen halides. More specifically, the invention relates to a process and apparatus for producing chlorine by the electrolysis of hydrochloric acid in a cell utilizing a solid polymer electrolyte and catalytic anodes and cathodes bonded to at least one surface of the membrane to electrolyze the hydrochloric acid.

The production of halogen by the electrolysis of aqueous hydrogen halides such as hydrochloric acid has generated substantial commercial interest because of the large quantity of excess hydrochloric acid available throughout the world as a by-product of organic chlorination operations and other industrial processes. The demand for hydrochloric acid as such, on the other hand, has not kept pace with the amount of such low-grade hydrochloric acid available. Disposing of such excess by-product HCl presents a troublesome environmental problem to the chemical industry since these large quantities of hydrochloric acid must be disposed of without polluting the environment. Thus, direct electrolysis of hydrochloric acid in water solutions is of great interest to industry since it provides a method for disposing of large quantities of excess hydrochloric acid, while at the same time producing chlorine for which there is a large and increasing industrial demand.

Chlorine has previously been prepared from hydrochloric acid by the electrolysis of aqueous solutions of hydrochloric acid in electrolytic cells of the diaphragm type. Typically, in such cells solid graphite electrodes are separated by suitable gaskets, and the spaces between the electrodes are filled with a hydrochloric acid solution and separated by a perforated diaphragm. During electrolysis, chlorine is released at the anode and hydrogen released at the cathode. However, the operating cell voltages in such commercially available electrolyzers are substantially in excess of the theoretical voltage at which chlorine is discharged at the anode and hydrogen at the cathode. This excess voltage in commercially available HCl electrolysis cells is principally due to the chlorine overvoltage at the graphite anode and hydrogen overvoltage on the graphite cathode, as well as the IR drops in the membrane and in the electrolyte. This of course affects the economics of the process since the electrolyzer operating costs are directly related to the cell voltage. Attempts to reduce overvoltages to reasonable values have required operation at low current densities which adversely affect capital costs. Attempts to reduce cell voltage and operational costs while operating at reasonable current densities, i.e., 300 amperes per square foot (ASF) or more necessitate operation at high temperatures; 80° C. (176° F.) or more. This, in turn, introduces many additional problems.

Furthermore, since these systems use a perforated diaphragm to separate the anolyte and catholyte compartments, gaseous hydrogen discharged at the cathode migrates back through the diaphragm to the anode. As a result, the chlorine contains substantial quantities of hydrogen, requiring gas separation equipment to produce the desired high-grade chlorine. There is also the problem of rapid depletion of the anolyte which reduces the HCl concentrations, increasing the rate of water electrolysis and oxygen evolution. Oxygen evolution is, of course, extremely troublesome since it attacks graphite resulting in rapid deterioration of the electrode.

Industrial HCl electrolysis cell design is plagued by a host of such problems which have seriously retarded chlorine generation by the electrolysis of hydrochloric acid.

It is therefore a primary object of this invention to provide method and apparatus for electrolytically producing halogens from hydrogen halides in a cell utilizing a solid polymer electrolyte in the form of an ion exchange membrane.

It is a further object of this invention to provide a method and apparatus for electrolytically producing chlorine from hydrochloric acid with substantially lower cell voltages, higher current densities, and at reasonable operating temperatures.

Yet, another object of this invention is to provide a method and apparatus for electrolytically producing chlorine from hydrochloric acid in which chlorine overvoltage at the anode electrode and hydrogen overvoltages on the cathode electrode is minimized.

Still another object of the invention is to provide a method and apparatus for electrolytically producing high purity chlorine by the electrolysis of hydrochloric acid in a highly economical and efficient manner.

Other objects and advantages of the invention will become apparent as the description thereof proceeds.

In accordance with the invention, a halogen such as chlorine is generated by electrolysis of a hydrogen chloride such as hydrochloric acid in a cell which includes a solid polymer electrolyte in the form of a cation exchange membrane which separates the cell into catholyte and anolyte chambers. A catalytic electrode is bonded to at least one surface of the membrane and preferably to both to provide catalytic anode and cathode electrodes with very low halogen and hydrogen overvoltages. An aqueous solution of HCl is continuously brought into contact with the anode. Chlorine is discharged at the anode and $H^+$ ions are transported to the cathode and discharged there. The catalytic electrodes take the form of a bonded mass of fluorocarbon (polytetrafluoroethylene) and graphite particles.

The graphite containing catalytic electrodes further include a catalytic material comprising at least one reduced platinum group metal oxide which is thermally stabilized by heating the reduced oxides in the presence of oxygen. Examples of useful platinum group metals are platinum, palladium, iridium, rhodium, ruthenium and osmium.

The preferred reduced metal oxides for chlorine production are reduced oxides or ruthenium or iridium. The electrocatalyst may be a single, reduced platinum group metal oxide such as ruthenium oxide, iridium oxide, platinum oxide, etc. In has been found, however, that mixtures or alloys of reduced platinum group metal oxides are more stable. Thus, an electrode of reduced ruthenium oxides containing up to 25% of reduced oxides of iridium, and preferably 5 to 25% of iridium oxide by weight, has been found very stable. Graphite is present in an amount up to 50% by weight, preferably 10–30%. Graphite has excellent conductivity with a low halogen overvoltage and is substantially less expensive than platinum group metals, so that a substantially less expensive yet highly effective halogen evolving electrode is possible.

One or more reduced oxides of a valve metal such as titanium, tantalum, niobium, zirconium, hafnium, vanadium or tungsten may be added to stabilize the electrode against oxygen, chlorine, and the generally harsh electroysis conditions. Up to 50% by weight of the valve metal is useful with the preferred amount being 25–50% by weight.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
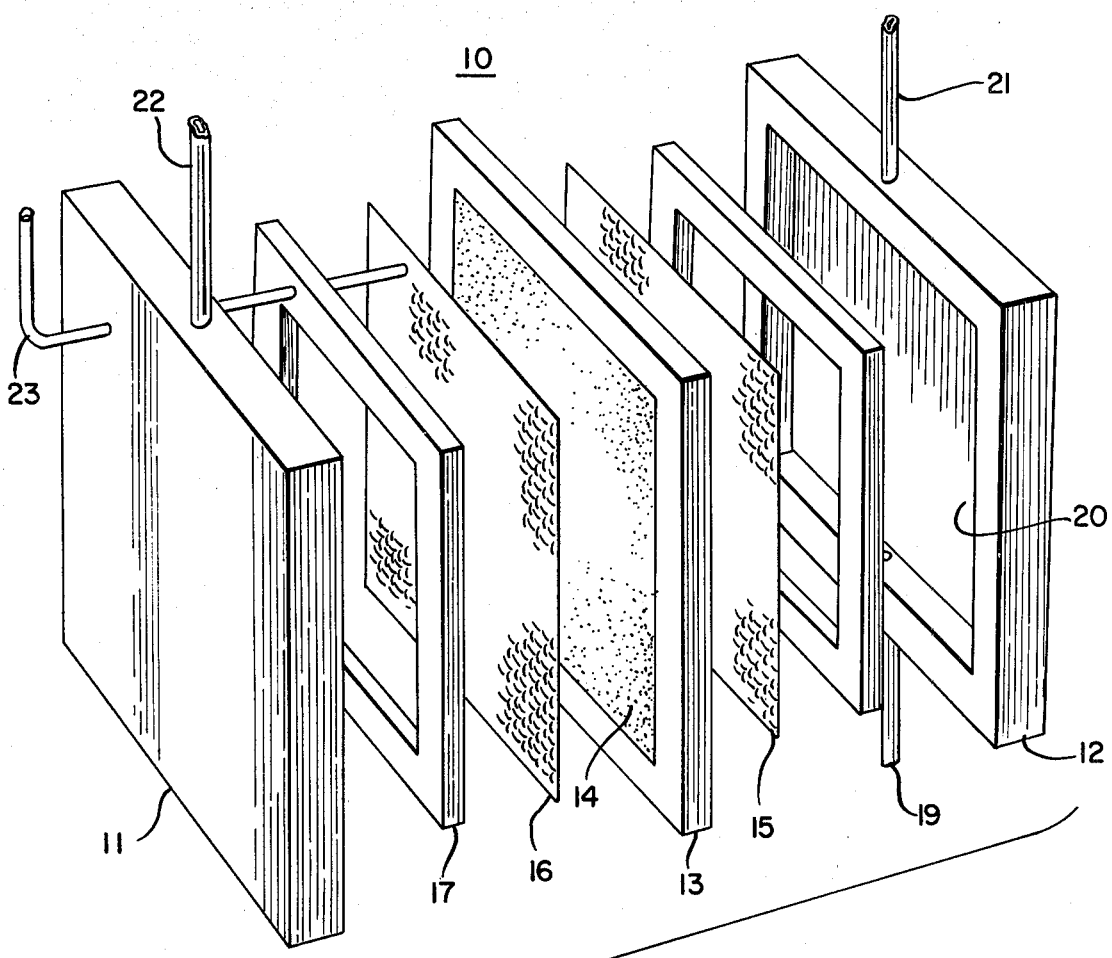
FIG. 1 is a diagramatic illustration of an electrolysis cell in accordance with the invention utilizing a solid polymer electrolyte membrane.

Referring now to FIG. 1, the overall electrolysis cell is shown generally at 10 and consists of a cathode compartment 11, an anode compartment 12, separated by a solid polymer electrolyte membrane 13 which is preferably a hydrated, selective cationic membrane. Bonded to opposite surfaces of membrane 13 are catalytic fluorocarbon bonded graphite electrodes used alone or mixed with thermally stabilized, reduced oxides of platinum group metals such as ruthenium, $RuO_x$, or stabilized reduced oxides of iridium, ruthenium-iridium, ruthenium-titanium, ruthenium-tantalum, or ruthenium-titanium-iridium. The cathode, shown at 14, is bonded to one side of the membrane and a catalytic anode, not shown, is bonded to the opposite side of the membrane.

The cathode is a Teflon-bonded mass of catalytic particles which may be the same as the anode catalyst, i.e., graphite alone or with thermally stabilized particles of reduced oxides of platinum group metal with or without transition valve metals. Alternatively, platinum black and mixtures and alloys of thermally stabilized, reduced oxides of Pt, Pt-Ir, Pt-Ru, Pt-Ni, Pt-Pd, Pt-Au may be utilized as the acid concentration on the cathode side, due to transport of HCl across the membrane with the $H^+$ ions is quite low; 10% or less of the anolyte concentration.

Current collectors in the form of metallic screens or porous sheets, i.e., graphite 15 and 16 are pressed against the electrodes. The whole membrane/electrode assembly is firmly supported between the housing elements 11 and 12 by means of gaskets 17 and 18, such as the filled rubber type sold by Irving Moore Company (Cambridge, Mass.) under its trade designation EPDM. An electrolyte inlet 19, through which the aqueous hydrochloric acid feed is introduced, communicates with anode chamber 20. Spent electrolyte and chlorine gas are removed through outlet conduit 21. Cathode outlet conduit 22 communicates with cathode chamber 11 to remove hydrogen produced at the cathode from cathode chamber 11, along with any water or hydrochloric acid which is prototonically pumped across membrane 13. Power cable 23 is brought into the cathode chamber and a corresponding cable, not shown, is brought into the anode chamber. The cables connect the current conducting screens 15 and 16 to a source of electrical power.

Figure 2:
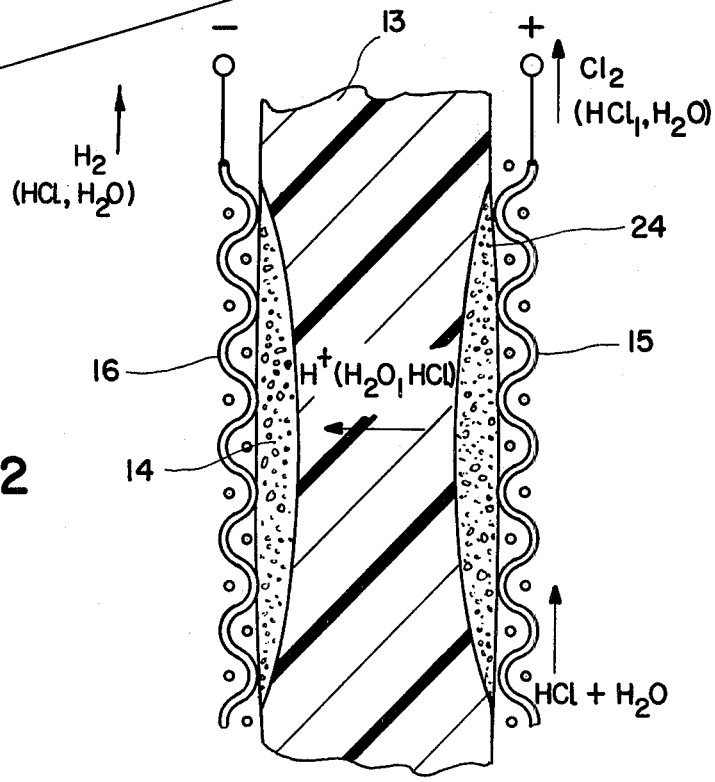
FIG. 2 is a schematic illustration of the cell and the reactions taking place in various portions of the cell.

FIG. 2 illustrates diagramatically the reactions taking place in various portions of the cell during HCl electrolysis, and is useful in understanding the electrolysis process and the manner in which the cell functions. An aqueous solution of hydrochloric acid is brought into the anode compartment which is separated from the cathode compartment by means of the cation membrane 13. The bonded graphite electrodes containing reduced oxides of Ru stabilized by reduced oxides of iridium or titanium, etc., are, as shown, pressed into the surfaces of membrane 13. Current collectors 15 and 16 are pressed against the surface of the catalytic electrodes and are connected, respectively, to the negative and positive terminals of the power source to provide the electrolyzing voltage across the electrodes. The hydrochloric acid brought into the anode chamber is electrolyzed at anode 24 to produce gaseous chlorine and hydrogen ions ($H^+$). The $H^+$ ions are transported, across membrane 13, to cathode 14 along with some water and some hydrochloric acid. The hydrogen ions are discharged at the cathode electrode which is also bonded to and embedded in the surface of the membrane. Cathode 14 may, for example, also consist of a fluorocarbon bonded graphite with thermally stabilized, reduced oxides of platinum group metals and valve metals, viz., Ru, Ir, Ti, Ta, etc. The reaction in various portions of the cell is as follows:

$$\text{Anode Reaction: } 2Cl^- \rightarrow Cl_2 \uparrow + 2e^- \quad (1)$$

$$\text{Membrane Transport: } 2H^+(H_2O, HCl) \quad (2)$$

$$\text{Cathode Reaction: } 2H^+ + 2e^- \rightarrow H_2 \uparrow \quad (3)$$

$$\text{Overall Reaction: } 2HCl \rightarrow H_2 + Cl_2 \quad (4)$$

In this arrangement, the catalytic sites in the electrodes are in direct contact with the cation membrane and the ion exchanging acid radicals attached to the polymer backbone (whether $SO_3H \times H_2O$ sulfonic acid radicals or COO $H \times H_2O$ carboxylic acid radicals). As a result, there is no IR drop to speak of in the anolyte or the catholyte fluid chambers (usually referred to as "electrolyte IR drop") and this is one of the principal advantages of this invention. Furthermore, because the chlorine and hydrogen are generated right at the electrode and membrane interfaces, there is no IR drop due to the so-called "bubble effect" which is a gas mass transport loss. That is, in prior art systems, gas formation occurs between the catalytic electrode which is spaced away from the membrane and the membrane. This layer or film of gas at least partially blocks ion transport between the catalytic electrode and the membrane and introduces a further IR drop.

ELECTRODES

The perfluorocarbon-polytetrafluoroethylene (also known by the Dupont trademark—Teflon) bonded, graphite electrode includes reduced oxides of platinum group metals such as ruthenium, iridium, ruthenium-iridium, etc., in order to minimize chlorine overvoltage at the anode. The reduced oxides of ruthenium are stabilized to produce an effective, long-lived anode which is stable in acids and has very low chlorine overvoltage. Stabilization is effected initially by temperature (thermal) stabilization; i.e., by heating the reduced oxide of ruthenium at a temperature below that at which the reduced oxides begin to be decomposed to the pure metal. Thus, preferably the reduced oxides are heated at 350°-750° C. from thirty (30) minutes to six (6) hours with the preferable thermal stabilization procedure being accomplished by heating the reduced oxides for one hour at temperatures in the range of 550° to 600° C. The Teflon-bonded graphite electrode with reduced oxides of valve metals such as ruthenium can be further stabilized by alloying or mixing the ruthenium with thermally stabilized, reduced oxides of other platinum group metals such as iridium ($IrO_x$), in the range of 5 to 25 percent of iridium with 25 percent being preferred, or palladium, rhodium, etc., and also with reduced oxides of titanium ($TiO_x$) with 25 to 50% $TiO_x$ preferred, or reduced oxides of tantalum (25% or more). It has also been found that ternary alloys of reduced oxides of titanium, ruthenium, and iridium (Ru, Ir, Ti)$O_x$, or tantalum, are very effective in producing a stable, long-lived anode. In the case of the ternary alloy, the composition is preferably 5 percent by weight of reduced oxide of iridium and equal percentages (47.5% by weight) of reduced oxides of ruthenium and of the transition valve metal titanium. For reduced oxides of ruthenium and titanium, the preferred range is 50% of ruthenium and 50% by weight of titanium. Titanium, of course, has the advantage of being much less expensive than either ruthenium or iridium. Other valve metals such as Nb or Zr, Hf can be readily substituted for the Ti or Ta in the electrode structures.

The alloys of the reduced noble metal oxides of ruthenium, iridium, along with the reduced oxides of titanium are blended with Teflon to form a homogenous mix. These are further blended with a graphite-Teflon mix to form the noble metal activated graphite structures. Typical noble metal loading for the anode is 0.6 $mg/cm^2$ of electrode surface with the preferred range being between one (1) to two (2) $mg/cm^2$.

The cathode may similarly be a mixture of Teflon-bonded graphite with the same alloys or mixtures of reduced oxides of ruthenium, iridium and titanium or with ruthenium itself. Alternatively, other noble metals such as reduced oxides of platinum, Pt-Ir or Pt-Ru may be utilized, since the cathode is not exposed to the high hydrochloric acid concentration of the anode which attacks and rapidly dissolves platinum. The HCl concentration at the cathode is normally ten times more dilute than the anolyte. The cathode electrode, like the anode, is bonded to and embedded in the surface of the cation membrane. The reduced ruthenium oxides lower the overvoltage for hydrogen discharge and the iridium and titanium stabilize the ruthenium.

The anode current collector which engages the bonded anode layer has a higher chlorine overvoltage than the catalytic anode. This reduces the probability of electrochemical reaction, such as chlorine evolution, taking place at the current collector surface. Preferred materials are Ta, Nb screens or porous graphite sheets. The chlorine evolving reaction is much more likely to occur at the bonded electrode surface because of its lower chlorine overvoltage and because of the higher IR drop to the collector surface.

Similarly, the cathode current collector is fabricated of a material which has a higher hydrogen overvoltage than the cathode. A preferred material is porous graphite sheet. Consequently, the probability of hydrogen evolution taking place at the current collector is reduced both because of the lower overvoltage and because the current collectors to some extent screen or shield the electrodes. By maintaining the cell voltages at the lowest level at which chlorine and hydrogen are evolved at the electrodes, no gas evolution takes place at the current collectors with their higher overvoltages for gas evolution.

MEMBRANE

Membrane 13 is preferably a stable, hydrated, cationic film which is characterized by ion transport selectivity. The cation exchange membrane allows passage of positively charged cations and minimizes passage of negatively charged anions. Various classes of ion exchange resins may be fabricated into membranes to provide selective transport of cations. Two classes are the so-called sulfonic acid cation exchange resins and carboxylic acid cation exchange resins. In the sulfonic acid exchange resins, which are the preferred type, the ion exchange groups are hydrated sulfonic acid radicals, $SO_3H \times H_2O$, which are attached to the polymer backbone by sulfonation. The ion exchanging, acid radicals are not mobile within the membrane but are fixedly attached to the backbone of the polymer, ensuring that the electrolyte concentration does not vary.

As pointed out previously, perfluorocarbon sulfonic acid cation membranes are preferred because they provide excellent cation transport, they are highly stable, they are not affected by acids and strong oxidants, they have excellent thermal stability, and they are essentially invariant with time. One specific preferred cation polymer membrane is sold by the Dupont Company under its trade designation "Nafion" and is one in which the polymer is a hydrated, copolymer of polytetrafluoroethylene (PTFE) and polysulfonyl fluoride vinyl ether containing pendant sulfonic acid groups. These membranes are used in the hydrogen form which is customarily the way they are obtained from the manufacturer. The ion exchange capacity (IEC) of a given sulfonic cation exchange membrane is dependent upon the milliequivalent (MEW) of the $SO_3$ radical per gram of dry polymer. The greater the concentration of the sulfonic acid radicals, the greater the ion exchange capacity and hence the capability of the hydrated membrane to transport cations. However, as the ion exchange capacity of the membrane increases, so does the water content and the ability of the membrane to reject salts decreases. In the case of the electrolysis of hydrochloric acid, one preferred form of the ion exchange membrane is one sold by the Dupont Company under its trade designation Nafion 120.

The ion exchange membrane is prepared by hydrating it in boiling water for a period of one hour to fix the membrane water content and transport properties.

ELECTRODE PREPARATION

The reduced oxides of the platinum group metals, i.e., of ruthenium, iridium and of the valve metal titanium, tantalum, etc., which are combined with the Teflon-bonded graphite, are prepared by thermally decomposing mixed metals salts directly or in the presence of excess sodium salts, i.e., nitrates, carbonates, etc. The actual method of preparation is a modification of the Adams method of platinum preparation by the inclusion of thermally decomposable halides of iridium, titanium, tantalum, or ruthenium, i.e., salts such as iridium chloride, tantalum chloride, ruthenium chloride, or titanium chloride. As one example, in case of the (Ru, Ir, Ti)$O_x$ ternary alloy finely divided halide salts of ruthenium and iridium and titanium are mixed in the same weight ratio of ruthenium, titanium, iridium as is desired in the alloy. An excess of sodium is incorporated and the mixture fused in a silica dish at 500° C. to 550° for three hours. The residue is washed thoroughly to remove the nitrates and halides still present. The resulting suspension of mixed oxides is reduced at room temperature by using an electrochemical reduction technique or, alternatively, by bubbling hydrogen through the mixture. The product is dried thoroughly, ground and sieved through a mesh nylon screen. The reduced oxides are thermally stabilized by heating thin layers of the catalyst for one hour at 550° to 600° C. prior to blending with Teflon. The alloy of the thermally stabilized, reduced oxides of ruthenium, iridium, and titanium is combined with Teflon and then combined with the graphite-Teflon mixture. If only a binary reduced oxide alloy is to be prepared, then obviously the proper combinations of the noble metal halides are mixed in the weight ratio desired in the final alloy and the procedure as set out above is followed.

The electrode is prepared by first mixing powdered graphite with polytetrafluoroethylene particles. One commercially available form of the graphite is sold by the Union Oil Company under its designation of Pocographite 1748. Polytetrafluoroethylene particles are available from the Dupont Company under its trade designation Teflon T-30. The amount of Teflon may be anywhere from 15 to 30 percent by weight. The preferred amount is 20 percent by weight.

The reduced oxides are blended with the graphite-Teflon mixture. The mixture of graphite, Teflon, and reduced noble metal oxides is placed in a mold and heated until the composition is sintered into a decal form which is then bonded to and embedded in the surfaces of the membrane by the application of pressure and heat. Various methods may be used, including the one described in detail in U.S. Pat. No. 3,134,697 entitled, "Fuel Cell", issued May 26, 1964 in the name of L. W. Niedrach and assigned to the General Electric Company, the assignee of the instant invention. In the process described therein, the electrode structure is forced into the surface of a partially polymerized ion exchange membrane, thereby integrally bonding the gas absorbing hydrophobic particle mixture to the membrane and embedding it in the surface of the membrane.

PROCESS PARAMETERS

For chlorine generation, an aqueous hydrochloric acid solution is introduced into the anolyte chamber. It is preferred that the feed rate be in the range of 1 to 4 L/min—ft$^2$. With these feed rates and with high acid concentration, oxygen evolution at the anode is minimized so that oxygen concentration is less than 0.02 percent. If the feedstock concentration and the flow rate are both too low, the relative amount of water present at the anode to compete with the HCl for catalytic reaction sites increases. As a result, water is electrolyzed to produce oxygen at the anode. Because oxygen attacks the graphite, oxygen generation should be minimized. It is preferred that the hydrochloric acid concentration exceed 7 N (equivalent/liter) with the preferred range being 9–12 N.

An operating potential of 1.8–2.2 volts, depending on the electrode composition and HCl concentration at 400 amperes per square foot is applied to the cell and the cell and feedstock solution is maintained at 30° C., i.e., room temperature. If the temperature at which the electrolysis cell is operated is increased, up to 80° C. or more (176° F.), the efficiency of the system is increased and the cell voltage required for chlorine generation is reduced. The effect of temperature on performance for a typical hydrated SPE electrolyzer operating with 9 to 12 N HCl is shown in Table I:

TABLE 1

Effect of Cell Operating Temperature on Performance of Hydrated SPE Electrolyzers

| Operating Current Density = 400 ASF | |
|---|---|
| Temperature (°C.) | Cell Voltage (V) |
| 30 | 1.85 |
| 50 | 1.70 |
| 80 | 1.52 |
| **Operating Current Density = 600 ASF** | |
| Temperature (°C.) | Cell Voltage (V) |
| 30 | 2.25 |
| 50 | 2.06 |
| 80 | 1.69 |

In the best present day commercial HCl electrolysis systems, a cell voltage of 2.1 volts at 370 amps per square ft. (ASF) is achievable only by operating at temperatures of 80° C. (176° F.). As Table I illustrates, the present invention results in operation at lower voltages than such commercial systems, at lower temperatures and higher current densities.

With the instant invention, the process may be run at room temperature levels (~30° C.) while still operating the cell at lower volages than the present day higher temperature cells. Increasing the cell operating temperature enhances voltage savings (efficiency), i.e., 0.6 to 0.7 V at 80° C. at a given current density.

As will be shown clearly in the subsequent examples, the chlorine electrolysis process of the instant invention permits efficient chlorine generation at cell voltages (1.80 to 2.2 volts) which are equal to or lower than presently achievable, at higher current densities (400 ASF) and at much lower temperatures (~30° C.). The economic benefits of operating at higher current densities, lower cell voltages, and much lower temperatures are obvious and of great significane.

The hydrochloric acid is electrolyzed to produce chlorine gas at the anode. The $H^+$ ions are transported across the membrane and discharged at the cathode to form hydrogen gas. The chlorine gas and the spent aqueous hydrochloric acid feedstock are removed from the cell and new feedstock brought in at a rate in the range previously described.

It may also be desirable to conduct the electrolysis at super atmospheric pressures to enhance removal of the gaseous electorlysis products.

Pressurizing the anolyte and catholyte compartments, above atmospheric, reduces the size of gas bubbles formed at the electrodes. The smaller gas bubbles are much more readily detached from the electrode and the electrode surface, thereby enhancing removal of the gaseous electrolysis products from the cell. There is an additional benefit in that it tends to eliminate or minimize formation of gas films at the electrode surface; films which can block ready access of the anolyte and catholyte solutions to the electrode. In a hybrid cell arrangement where only one electrode is bonded to the membrane, reduction of bubble size minimizes gas blending and mass transfer losses (IR drop due to "bubble effect") in the space between the non-bonded electrode and the membrane due to interruption of the electrolyte path is less with smaller bubbles.

The cation exchange membrane may be approximately 4 to 12 mils thick. The materials of which the cell is constructed may be materials which are resistant to hydrochloric acid and chlorine in the case of the anolyte chamber and are not subject to hydrogen brittlement in the case of the catholyte chamber. Thus, the anode housings may be made of tantalum, niobium, and graphite, the screens of tantalum or niobium and the gaskets of a filled rubber such as EPDM. Graphite is the preferred material of construction for the cathode. Alternatively, the entire cell housing and end plates may be made of pure graphite or other organic materials not subject to attack by the fluids and gases present in the housing.

EXAMPLES

Cells including electrodes containing thermally stabilized, reduced oxides of platinum group metals and valve metal bonded to ion exchange membranes were built and tested to illustrate the effect of various operating parameters on the effectiveness of the cell and the catalyst in the electrolysis of hydrochloric acid.

Table II illustrates the Effect on Cell Voltage of various combinations of the thermally stabilized, reduced oxides of platinum group metals. Cells were constructed with Teflon-bonded graphite electrodes containing various combinations of reduced oxides bonded to 12 mil hydrated cationic membrane. The cell was operated with a current density of 400 amps per square ft. at 30° C., at a feed rate of 70 cc per minute, (0.05 $Ft^2$ active cell area) with feed normalities of 9–11 N.

Tables III and IV illustrate the effect of time for the same cells and under the same conditions, on cell operating voltages.

Table V shows oxygen generated at the anode for various flow rates and at various HCl concentrations.

Table VI shows the effect of acid feed concentration ranging from 7.5–10.5 N. A cell, like cell No. 5 in Table II, was constructed with thermally stabilized, reduced oxides of platinum group metals (Ru, 25% Ir) added to the Teflon-bonded graphite. The cell was operated at fixed feed rate of 150 cc/min, (0.05 $Ft^2$ active cell area) at 30° C. and 400 ASF.

TABLE III

| Cell No. | Cell Voltage (V) At 100 Hrs. Operating Time | Cell Voltage (V) At Operating Time From Table I | Current Density Amperes Per Square Foot (ASF) |
|---|---|---|---|
| 1 | 1.85 | 2.10 | 400 |
| 2 | 1.84 | 2.01 | 400 |
| 3 | 1.78 | 1.97 | 400 |
| 4 | 1.80 | 1.91 | 400 |
| 5 | 1.75 | 2.07* (1.9) | 400 |
| 6 | 1.70 | 1.80 | 400 |

*See note for Table II.

TABLE IV

| Cell No. | Intermediate Operating Time - (Hrs.) | Current Density Amperes/Sq. Ft. (ASF) | Cell Voltages (V) |
|---|---|---|---|
| 1 | 3900 | 100 | 1.70 |
| | | 200 | 1.93 |
| | | 300 | 2.00 |
| 2 | 3400 | 100 | 1.57 |
| | | 200 | 1.70 |
| | | 300 | 1.83 |
| 3 | 1900 | 100 | 1.58 |
| | | 200 | 1.70 |
| | | 300 | 1.81 |
| 4 | 1000 | 1000 | 1.47 |
| | | 2000 | 1.60 |
| | | 300 | 1.72 |
| 5 | 1200 | 100 | 1.32 |
| | | 200 | 1.45 |
| | | 300 | 1.55 |

TABLE V

| Feed Concentration (Eq/L) | Volume % - Oxygen | Flow Rate - (cc/Min) |
|---|---|---|
| 7.5 | 1.4% | 65 |
| | 0.87 | 75 |
| | 0.5 | 100 |
| | 0.15 | 150 |
| | 0.05 | 200 |
| 10.5 | 0.29 | 75 |
| | 0.15 | 100 |
| | 0.03 | 150 |
| | 0.01 | 200 |

TABLE II

| Cell No. | Operational Time (Hrs.) | Anode-Graphite/ Fluorocarbon Plus | Loading ($Mg/Cm^2$) | Cathode-Graphite/ Fluorocarbon Plus | Loading ($Mg/Cm^2$) | Feed Normality (Eq/L) | Current Density - Amperes/Sq. Ft. (ASF) | Cell Voltage (V) |
|---|---|---|---|---|---|---|---|---|
| 1 | 6300 | $(Ru)O_x$ Heat Stabilized | 0.6 | $(Ru)O_x$ Heat Stabilized | 0.6 | 9–11 | 400 | 2.10 |
| 2 | 5300 | $(Ru\ Ti)O_x$ Heat Stabilized | 0.6 | $(Ru\ Ti)O_x$ Heat Stabilized | 0.6 | 9–11 | 400 | 2.01 |
| 3 | 4900 | $(Ru\ Ti)O_x$ Heat Stabilized | 1.0 | $(Ru\ Ti)O_x$ Heat Stabilized | 1.0 | 9–11 | 400 | 1.97 |
| 4 | 1800 | $(Ru\ Ti)O_x$ Heat Stabilized | 1.0 | $(Ru)O_x$ Heat Stabilized | 1.0 | 9–11 | 400 | 1.91 |
| 5 | 4000 | $(Ru\ 25\%\ Ir)O_x$ Heat Stabilized | 1.0 | $(Ru\ 25\%\ Ir)O_x$ Heat Stabilized | 1.0 | 9–11 | 400 | 2.07* (1.9) |
| 6 | 200 | $(Ru,Ti,5\%\ Ir)O_x$ Heat Stabilized | 2.0 | $(Ru,Ti,5\%\ Ir)O_x$ Heat Stabilized | 2.0 | 9–11 | 400 | 1.80 |
| 7 | 100 | $(Ru\text{-}25\%\ Ta)O_x$ | 2.2 | $(Ru,\ 25\%\ Ta)O_x$ | 2.0 | 9–11 | 400 | 1.64 |

*Performance of this cell at 3800 hours was approximately 1.9V. Taken off test due to cell leakage.

TABLE VI

| Feed Normality (eQ/L) | Volume % $O_2$ |
|---|---|
| 7 | 0.4 |
| 7.5 | 0.15 |
| 8 | 0.04 |
| 8.5 | 0.015 |
| 10 | 0.007 |
| 10.5 | 0.004 |
| 11.5 | 0.003 |

From the above examples, it will be clear that electrolysis of a hydrogen halide such as HCl produces chlorine substantially free of oxygen. The catalyst used in the electrolyzer cell along with the bonded electrode configuration is characterized by low overvoltage. The process may be carried out at low temperatures (~30° C.) resulting in economical operation in such electrolyzer cells. Furthermore, this data shows a very efficient process with excellent performance at high current densities, particularly at 300–400 ASF. This, of course, has a positive and beneficial effect on capital costs of chlorine electrolyzers embodying the instant invention.

While the instant invention has been shown in connection with a preferred embodiment thereof, the invention is by no means limited thereto, since other modifications of the inventions and variations of the instrumentalities employed in the steps carried out may be implied and fall within the scope of the invention. The invention is intended to include such modifications as may be embraced within the following claims.

What we claim as new and desire to secure by Letters Patent of the United States is:

1. A process for the continuous production of chlorine from hydrochloric acid which comprises:

(a) continuously providing an aqueous solution of hydrochloric acid to the anode compartment of an electrolytic cell which is separated from the cathode compartment by a cation selective ion exchange membrane, bringing the solution into contact with a catalytic, bonded, graphite anode electrode activated with reduced platinum group metals and oxides thereof bonded to and embedded in the membrane on the side facing the anode compartment said anode being opposite to a catalytic cathode bonded to and embedded in the other side of the membrane forming a unitary electrode-membrane structure whereby catalytic sites in the electrodes are in contact with the ion exchanging sites of the membrane so that electrolysis takes place directly at the membrane-electrode interface, (b) applying a potential to the electrodes through separate electron conductive current collectors in physical contact with the bonded electromechanically active electrodes to electrolyze the aqueous hydrochloric acid solution to produce chlorine at the anode electrode and hydrogen ions which are transported across said membrane to produce hydrogen at the cathode electrode, (c) continuously removing chlorine from the anode compartment and hydrogen from the cathode department.

2. The process of claim 1 wherein the aqueous hydrochloric acid solution is brought into contact with the electrode in which the reduced platinum group metal oxides are temperature stabilized, reduced oxides of ruthenium.

3. The process of claim 2 wherein the aqueous hydrochloric acid solution is brought into contact with the electrode which is further stabilized and includes reduced metallic oxides chosen from the group consisting of the reduced oxides of iridium, tantalum, titanium, and niobium to form a binary system.

4. The process of claim 3 wherein the aqueous hydrochloric acid solution is brought into contact with the electrode which is further stabilized by the inclusion of reduced oxides of iridium.

5. The process of claim 4 wherein the aqueous hydrochloric acid solution is brought into contact with the electrode and the reduced oxides of ruthenium and iridium are stabilized by the inclusion of reduced oxides chosen from the group consisting of the reduced oxides of titanium, the reduced oxides of niobium and the reduced oxides of tantalum to form a ternary system.

6. The process of claim 5 wherein the aqueous hydrochloric acid solution is brought into contact with the electrode which includes the reduced oxides of titanium to form the ternary system with the the reduced oxides of ruthenium and iridium.

7. A process for generating a halogen which comprises electrolyzing an aqueous solution of a hydrogen halide between a pair of electrodes separated by an ion permeable membrane, the improvement which comprises conducting the electrolysis with at least one of the electrodes including an electronconductive platinum group metal catalyst bonded to the membrane at a plurality of points forming a unitary electrode membrane structure exposed to an aqueous electrolyte wherein electrolysis of the aqueous solution is effected to keep oxygen evolution at the halogen evolving electrode below 5% by volume.

8. The process according to claim 7 wherein the oxygen at the halogen evolving electrode is below 2% by volume.

9. The process according to claim 7 wherein the hydrogen halide concentration is maintained in excess of 7 N to maintain the oxygen concentration below 5% by volume.

10. The process according to claim 7 wherein the hydrogen halide concentration is maintained in the range 7–12 N to maintain the oxygen concentration below 2% by volume.

11. The process according to claim 7 wherein the ion permeable member is hydraulically impermeable and restrains flow of electrolyte from the anode side to the cathode side, and the plurality of electroconductive particles are bonded together by a fluorocarbon polymer to form a gas permeable layer bonded to one surface of the ion permeable membrane.

12. The process according to claim 4 wherein each of the electrodes comprises a thin layer of finely divided electroconductive catalytic particles bonded to opposite surfaces of the membrane to provide gas permeable anode and cathode electrodes whereby the catalytic sites in the electrodes are in contact with ion exchanging radicals in the membrane.

13. A process for generating a halogen which comprises electrolyzing an aqueous solution of a hydrogen halide between a pair of electrodes separated by an ion permeable membrane, the improvement which comprises conducting the electrolysis with at least one of the electrodes, including an electroconducting, thermally stabilized, reduced oxide of a platinum group metal bonded to the membrane at a plurality of points to form a unitary electrode-membrane structure, supplying potential to the electrodes by electron conductive current distributors the surface of which is in contact with the electrode and is exposed to the electrolyte, said electrodes having lower hydrogen or chlorine overvoltages than the electron current distributors in physical contact therewith.

14. The process according to claim 13 wherein the other electrode includes electroconducting, catalytic particles bonded to the membrane at a plurality of points, said electrodes respectively having lower hydrogen and chlorine overvoltages than the electron current distributors in physical contact therewith.

15. The process according to claim 14 wherein the particles of the reduced oxides of ruthenium are activated by the inclusion of at least one thermally stabilized, reduced oxide of platinum group or transition metals.

16. The process according to claim 13 wherein each of the electrodes comprises a layer of electroconductive, thermally stabilized, reduced oxide particles of a platinum group metal bonded to opposite surfaces of the membrane to provide gas permeable anode and cathode electrodes.

17. The process according to claim 16 wherein the layers of particles forming include electroconductive graphite particles and particles of a material of the group consisting of electroconductive noble metal oxides.

18. The process according to claim 17 wherein the electroconductive graphite particles in the cathode and anode layers are activated by ruthenium oxide particles.

19. The process according to claim 18 wherein the electroconductive particles in each of the layers are activated by the inclusion of at least two kinds of particles of materials including noble metal oxides and transition metal oxides with at least one of the two kinds of particles being noble metal oxide particles.

20. The process according to claim 13 wherein the anode comprises a layer or particles of thermally stabilized, reduced oxides of a platinum group metal bonded to the membrane, and the electron conductive current distributor in contact with said anode has a higher chlorine overvoltage than the anode electrode.

21. The process according to claim 13 wherein the cathode includes a layer of electroconductive, catalytic particles bonded to the membrane and the electron conductive current distributor in physical contact therewith has a higher hydrogen overvoltage than said cathode electrode.

22. The process according to claim 13 wherein the anode and cathode electrodes are both bonded to the membrane and the electron conductive current distributors in contact with said anode and cathode electrodes have chlorine and hydrogen overvoltages which are higher than those of the bonded cathode and cathode electrodes respectively.

* * * * *